US010683148B2

(12) United States Patent
Adam et al.

(10) Patent No.: US 10,683,148 B2
(45) Date of Patent: Jun. 16, 2020

(54) TANK FILLING DEVICE WITH VENT FOR A LIQUID CONTAINER

(71) Applicant: Andreas Stihl AG & Co. KG, Waiblingen (DE)

(72) Inventors: Roland Adam, Besigheim (DE); Steffen Joos, Murr (DE); Benjamin Wichtler, Waiblingen (DE); Klaus-Martin Uhl, Plochingen (DE); Jonas Lank, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 132 days.

(21) Appl. No.: 15/668,802

(22) Filed: Aug. 4, 2017

(65) Prior Publication Data

US 2018/0037379 A1 Feb. 8, 2018

(30) Foreign Application Priority Data

Aug. 5, 2016 (DE) ..... 10 2016 009 489

(51) Int. Cl.

| | |
|---|---|
| ***B65D 47/32*** | (2006.01) |
| ***B67D 7/00*** | (2010.01) |
| ***B65D 47/28*** | (2006.01) |
| ***B67D 7/04*** | (2010.01) |
| ***B67D 7/42*** | (2010.01) |

(52) U.S. Cl.

CPC ..... *B65D 47/32* (2013.01); *B65D 47/28* (2013.01); *B67D 7/005* (2013.01); *B67D 7/04* (2013.01); *B67D 7/42* (2013.01)

(58) Field of Classification Search

CPC ..... B65D 47/28; B65D 47/32; B67D 7/005; B67D 7/04; B67D 7/42

See application file for complete search history.

(56) References Cited

U.S. PATENT DOCUMENTS

| | | | | |
|---|---|---|---|---|
| 3,207,190 A * | 9/1965 | Silbereis | ..... | H01M 2/36 137/454 |
| 5,228,487 A | 7/1993 | Thiermann et al. | | |
| 6,435,380 B1 * | 8/2002 | Raboin | ..... | B67D 7/005 141/292 |
| 6,871,680 B2 * | 3/2005 | Trippi, Jr. | ..... | B67D 7/005 141/302 |

(Continued)

FOREIGN PATENT DOCUMENTS

WO 2014/137216 9/2014

*Primary Examiner* — Andrew D Stclair
(74) *Attorney, Agent, or Firm* — Gudrun E. Huckett

(57) ABSTRACT

A tank filling device for a liquid container has a base body with mounting end to secure the base body on a liquid container. An actuating section is disposed in the base body interior and slidable lengthwise relative to the base body. A liquid valve is connected to an outlet opening for liquid and controls the outlet opening by being coupled to the actuating section such that the liquid valve is manually opened or closed by moving the actuating section. An air channel with air inlet and air outlet supplies air into the liquid container for pressure compensation. The air channel extends from the liquid valve toward the mounting end and has an air valve at the air outlet. The air outlet is provided between the actuating section and the base body and is a slot control valve formed by actuating section and base body.

12 Claims, 10 Drawing Sheets

(56) References Cited

U.S. PATENT DOCUMENTS

| | | | | |
|---|---|---|---|---|
| 2004/0025968 | A1* | 2/2004 | Allen | B67D 7/005 141/351 |
| 2015/0368007 | A1 | 12/2015 | Lank | |
| 2016/0016780 | A1* | 1/2016 | Van Gelder | B67D 7/005 222/482 |

* cited by examiner

TANK FILLING DEVICE WITH VENT FOR A LIQUID CONTAINER

BACKGROUND OF THE INVENTION

The invention relates to a tank filling device for a liquid container that is comprised of a base body with a mounting end for securing on the liquid container and with an actuating section that is guided to be slidable in longitudinal direction on the base body as well as with an outlet opening for the outflowing liquid which is controlled by a manually actuated liquid valve. The liquid valve is coupled with the actuating section such that the liquid valve can be manually opened and closed by displacing the actuating section. Moreover, an air channel with an air inlet and an air outlet for supply of air into the liquid container is provided for the purpose of pressure compensation in the liquid container, wherein the air channel is extending from the region of the liquid valve in the direction toward the mounting end and is provided at its air outlet with an air valve.

A known tank filling device is secured with a mounting end on a liquid container and comprises an actuating section that is conducting the outflowing liquid and is provided with a pouring spout on which an outlet opening for the outflowing liquid is provided. In the actuating section, an air channel is extending for supply of air into the liquid container for the purpose of pressure compensation, wherein the air channel is extending from one inner end, positioned at the mounting end, of the actuating section to an outer end, forming the outlet opening, of the actuating section. For control of the liquid flow, the pouring socket is closed by a liquid valve that is to be actuated manually.

Venting of the liquid container through the air channel can be disrupted when liquid penetrates into the air channel. A uniform flow of the liquid through the tank filling device without disruption is not reliably ensured in case of a liquid-filled air channel.

It is the object of the invention to further develop a tank filling device of the aforementioned kind in such a way that even under unfavorable filling conditions a uniform venting is ensured in order to obtain a uniform flow behavior of the liquid to be poured out.

SUMMARY OF THE INVENTION

The object is solved in that the actuating section is guided in the interior of the base body and the air outlet of the air channel is provided between the actuating section and the base body. In this context, the air valve is formed by the actuating section and the base body in the form of a slot control valve.

The actuating section is guided within the base body of the tank filling device, wherein the air outlet of the air channel is provided between the actuating section and the base body. In this context, the air valve is formed as a slot control valve between the actuating section and the base body.

In a simple configuration, the air outlet of the air channel can be provided in the actuating section and face the inner wall surface of the base body. In the inner wall surface of the base body, a control slot is formed by means of which the air valve can be actuated as a slot control valve. In this context, it is expedient that the liquid valve and the air valve are mechanically coupled with each other.

Preferably, it is provided to keep a compensation cross section open in the closed position of the air valve so that the liquid that has entered the air channel can flow out through the compensation cross section. The compensation cross section has advantageously a size that amounts to 1% to 5% of the opening cross section of the air valve in the open position.

In a further embodiment of the invention, the air inlet of the air channel is expediently designed such that the air inlet is positioned in the plane of the outlet opening for the liquid.

The liquid valve controlling the outlet opening comprises a sealing seat and a valve member, wherein the valve member closes off both the liquid valve and the air inlet into the air channel. Preferably, the liquid valve is designed such that a residual opening for air entry remains open in the closed position of the liquid valve. In this way, a residual cross section for an air flow is provided which enters in the direction toward the interior of the base body and ensures venting of the air channel in the closed position of the liquid valve.

The valve member is preferably configured as a valve plate. In this context, the valve plate is expediently secured on a valve stem that penetrates the actuating section centrally. A fastening end of the valve stem is secured in the base body of the tank filling device.

The interior of the actuating section is divided; it is separated into a liquid channel and into an air channel. The liquid channel and the air channel extend straight along a common longitudinal axis of the tank filling device.

The air outlet of the air channel is designed such that it opens into a circumferential region of the actuating section. In this way, between the air outlet and the end of the actuating section a control ring remains that determines the function of the slot control air valve.

Further features of the invention result from the further claims, the description, and the drawings in which an embodiment of the invention is illustrated that will be explained in the following in more detail.

DESCRIPTION OF PREFERRED EMBODIMENTS

Figure 3:
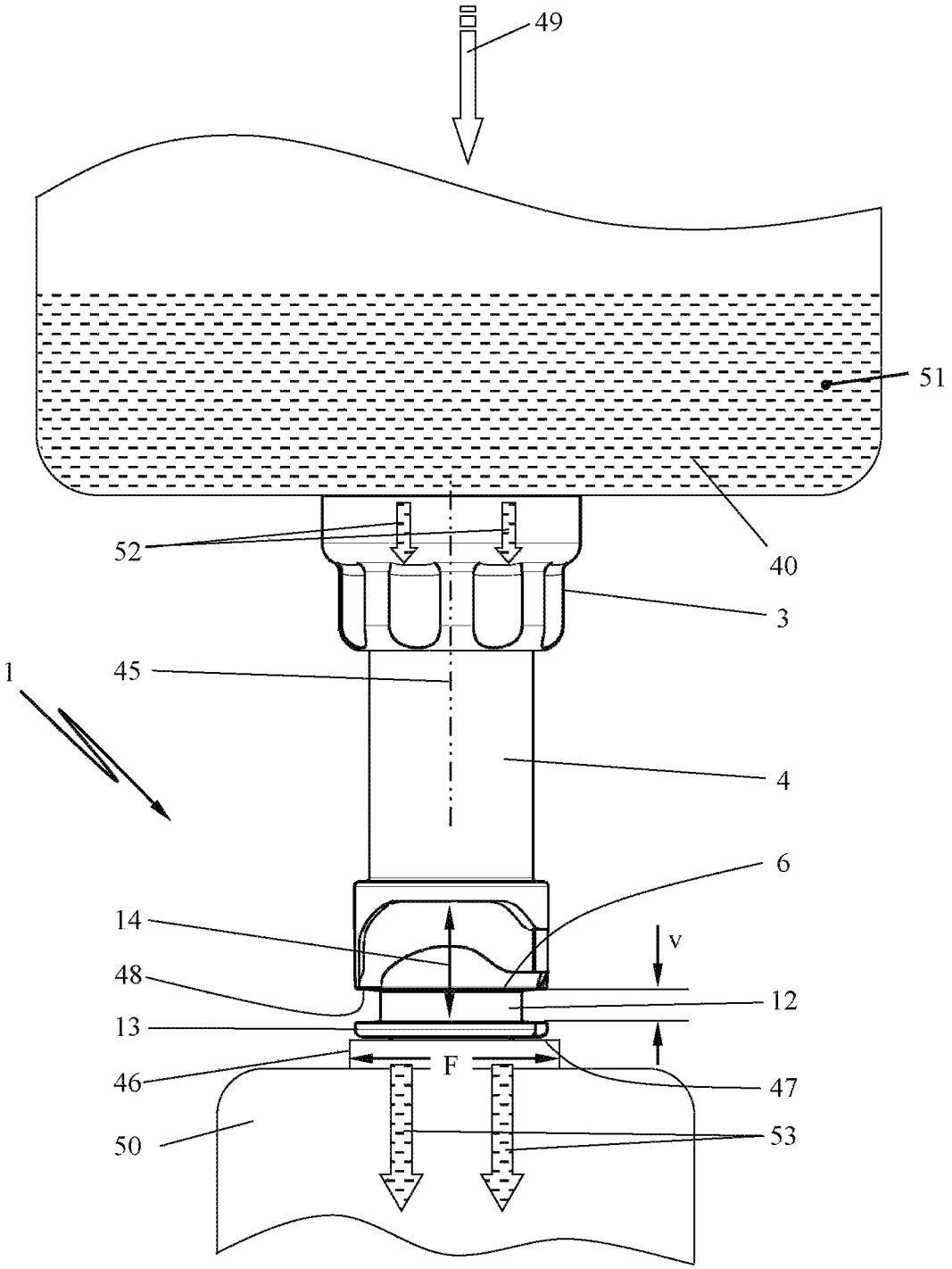
FIG. 3 shows in schematic illustration a tank filling device screwed onto a liquid container in a working position for filling a fuel container.

The illustrated embodiment shows a tank filling device 1 comprising a mounting end 2 in the form of a screw cap 3. The cylindrical tank filling device 1 is to be secured by means of the screw cap 3 of the mounting end 2 on a liquid container 40 (FIG. 3). The liquid container 40 is, for example, a fuel container as it is carried along by a user for refilling—on site—power tools that are operated by internal combustion engines.

Figure 1:
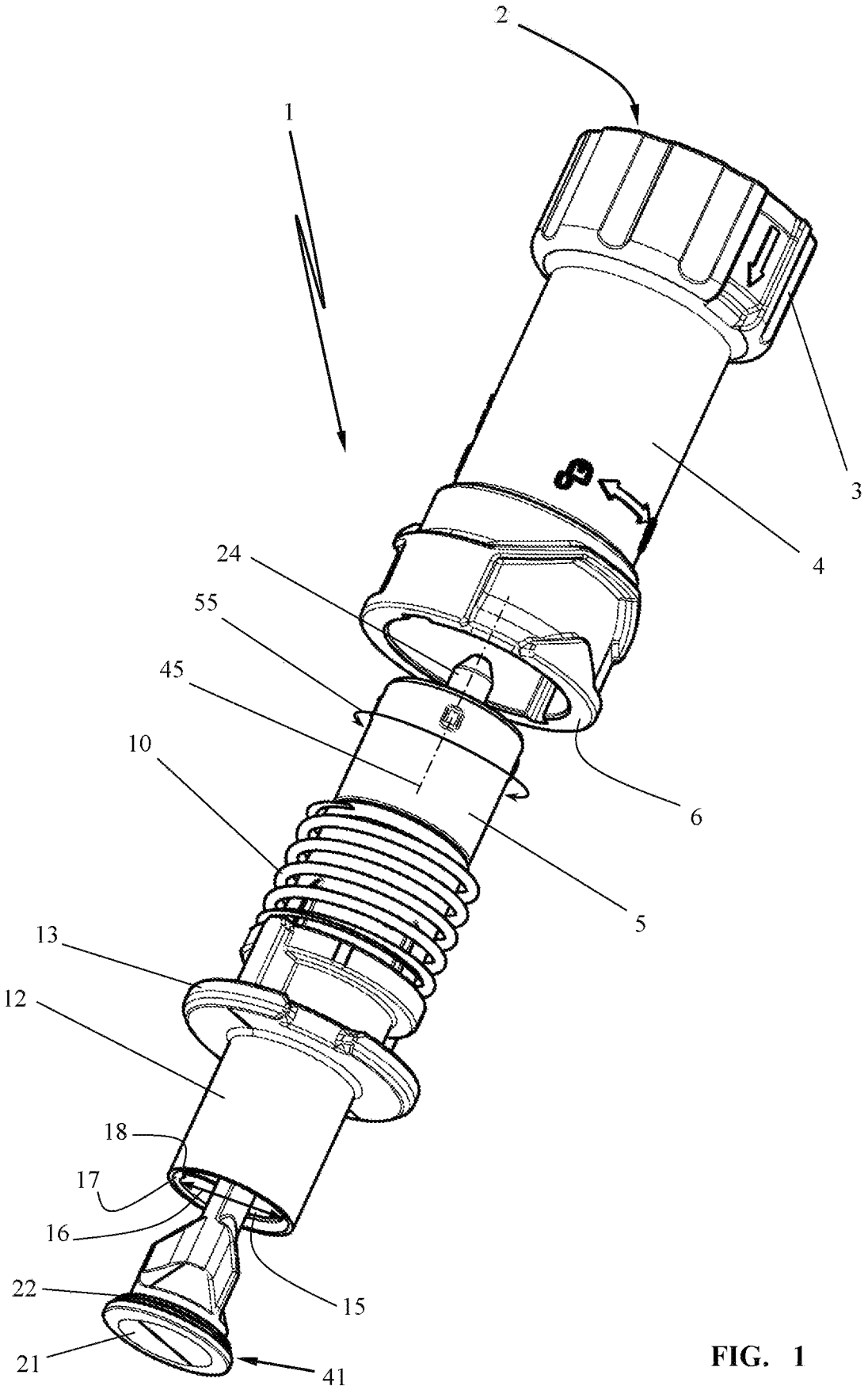
FIG. 1 shows a perspective view of a tank filling device in a partially demounted illustration.
Figure 2:
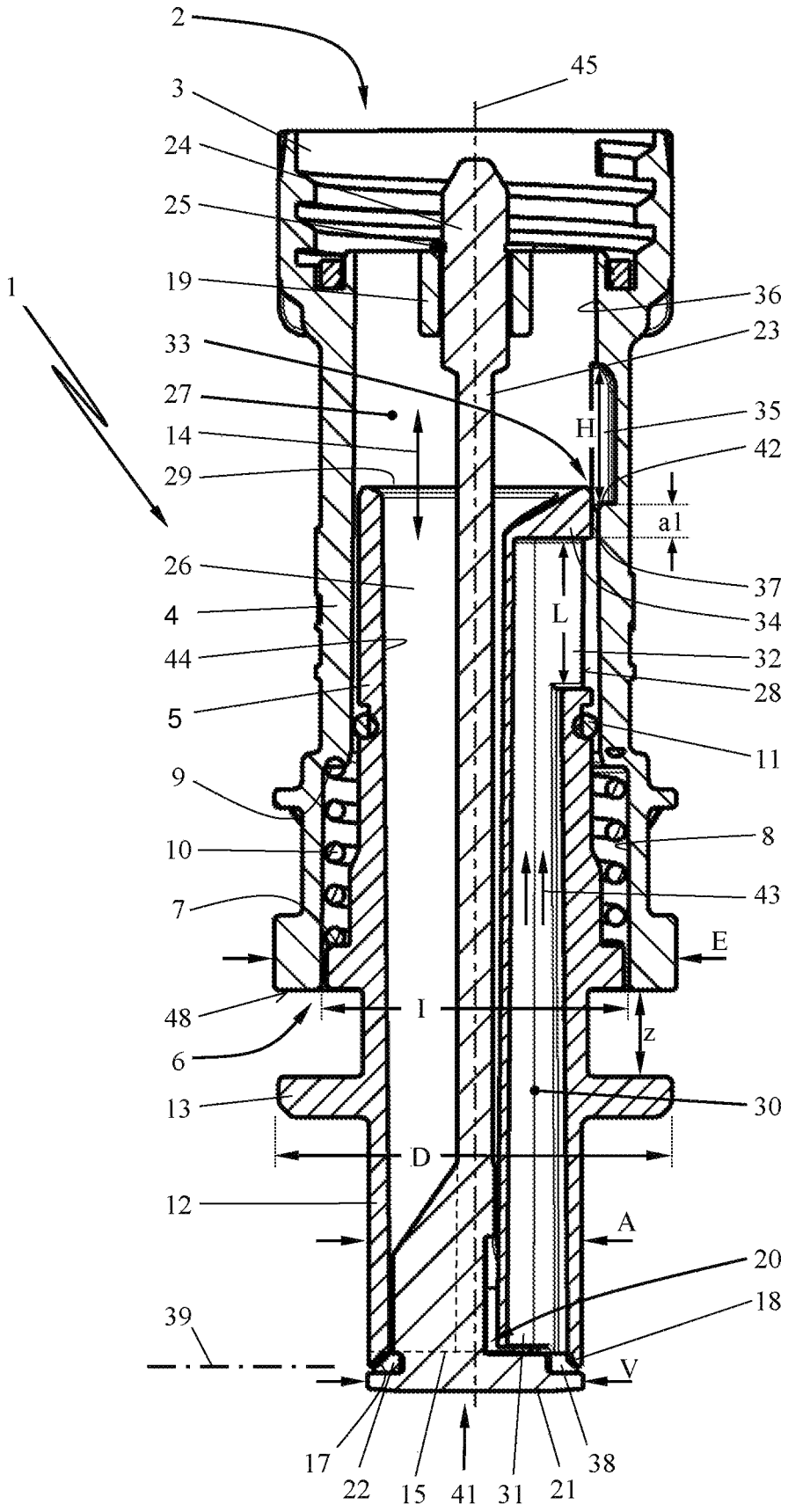
FIG. 2 is a longitudinal section view of a mounted tank filling device according to FIG. 1 in closed position.

As illustrated in FIGS. 1 and 2, the tank filling device 1 is substantially comprised of a base body 4 that is provided with the mounting end 2. The base body 4 that is advantageously cylindrical accommodates an expediently cylindrical actuating section 5 which is pushed into the end 6 of the base body 4 opposite the mounting end 2. The actuating section 5 comprises an annular shoulder 7 which is received in a widened section 8 of the open end 6. The widened section 8 comprises an inner annular shoulder 9. A spring 10 is positioned and acting between the annular shoulder 9 of the widened section 8 and the annular shoulder 7 of the actuating section 5. In the illustrated embodiment, the spring 10 is embodied as a coil spring which is supported with one end on the annular shoulder 7 of the actuating section 5 and with the other end on the annular shoulder 9 of the base body 4.

The actuating section 5 is guided within the base body 4 in a liquid-tight way. In the embodiment, the actuating section 5 comprises a seal 11 which is formed preferably as an O-ring. The seal 11 seals the movement gap between the outer circumference 28 of the actuating section 5 and the inner wall surface 36 of the base body 4.

The actuating section 5 projects with a preferably cylindrical pouring spout 12 out of the base body 4. The pouring spout 12 supports an annular flange 13 whose outer diameter D is greater than the inner diameter I of the open end 6 of the base body 4. Preferably, the outer diameter D of the annular flange 13 corresponds to the outer diameter E of the base body 4 at the open end 6. The actuating section 5 is guided liquid-tightly in the direction of double arrow 14 in the base body 4.

The pouring spout 12 comprises an outlet opening 15 through which an outflowing liquid is dispensed from the tank filling device 1.

The outlet opening 15 is controlled by a liquid valve 20 which is to be actuated manually in the embodiment. For this purpose, the liquid valve 20 interacts with the actuating section 5; this will be described in detail in the following.

The liquid valve 20 is comprised of a valve member 41 in the form of a valve plate 21 that has an outer diameter V. The valve member 41 or valve plate 21 covers the outlet opening 15 across the entire opening cross section 16 (FIG. 1). Expediently, the valve member 41 or valve plate 21 supports a sealing ring 22 which is interacting with an opening rim 18 of the pouring spout 12 that forms a valve seat 17.

The valve member 41 or valve plate 21 is secured on a valve stem 23 which expediently centrally penetrates the actuating section 5 and the base body 4 of the tank filling device 1. The valve stem 23 engages with a fastening end 24 a holding section 19 of the base body 4. The fastening end 24 of the valve stem 23 is axially expediently secured by means of the securing disk 25 in the holding section 19 of the base body 4.

The actuating section 5 with the pouring spout 12 is forced by spring 10 in the direction toward the valve plate 21 so that the opening rim 18 of the pouring spout 12 that forms a valve seat 17 is seal-tightly seated on the sealing ring 22 of the valve plate 21. Since the valve plate 21 is axially secured by means of the valve stem 23 and its fastening end 24 in the securing section 19 of the base body 4, the actuating section 5 is securely held in place in the base body 4.

The actuating section 5 forms a pouring socket 44 and comprises an inner liquid channel 26 which connects the interior of the base body 4 with the outlet opening 15 of the pouring spout 12. By means of the liquid channel 26, the liquid flows from the mounting end 2 to the outlet opening 15 controlled by the liquid valve 20.

Within the actuating section 5 an air channel 30 is formed which is extending from the outlet opening 15 of the pouring spout 12 in the direction toward the mounting end 2. The liquid channel 26 and the air channel 30 extend straight along a common longitudinal axis 45 of the tank filling device 1. The air channel 30 comprises an air inlet 31 in the area of the outlet opening 15 as well as an air outlet 32 which opens into a liquid chamber 27 of the base body 4. The air outlet 32 of the air channel 30 is positioned axially in a region between the seal 11 and the mounting end 2. The air outlet 32 opens into the sealed liquid chamber 27 of the base body 4.

The air outlet 32 of the air channel 30 is controlled by an air valve 33 which is embodied as a slot control valve. For this purpose, it is provided that the air outlet 32 opens in a circumferential region at the outer circumference 28 of the actuating section 5. Between the inner end 29 of the actuating section 5 and the air outlet 32 in the outer circumference 28 of the actuating section 5, there remains a control ring 34 which forms the end section of the actuating section 5. The air outlet 32 has associated therewith a control slot 35 in the inner wall surface 36 of the base body 4; this control slot 35 extends as a cutout axially across a height H of the base body 4. The control slot 35 in circumferential direction 55 (FIG. 1) of the base body 4 can have a width of a few degrees of peripheral angle. A width is expediently provided that amounts to a peripheral angle of 1° to 10°.

The air outlet 32 has a height L measured in axial direction of the air channel 30. The air outlet 32 can extend in circumferential direction 55 (FIG. 1) of the actuating section 5 about several degrees of peripheral angle. Expediently, the air outlet 32 in circumferential direction 55 (FIG. 1) has a width that amounts to a peripheral angle of 1° to 10°.

The air outlet 32, together with the control ring 34 and the control slot 35, forms the air valve 33 which is embodied between the base body 4 and the actuating section 5. The air outlet 32 is facing the inner wall surface 36 of the base member 4.

In the closed position of the tank filling device 1 which is illustrated in FIG. 2, the air valve 33 is in closed position. In this closed position illustrated in FIG. 2, a gap remains between the control ring 34 and the inner wall surface 36 of the base member 4; this gap is provided as a compensation cross section 37. By means of the gap between the control ring 34 and the inner wall surface 36 of the base member 4, liquid that has entered the air channel 30 can flow out as soon as the liquid container 40 has been put down and the tank filling device 1 is pointing upwardly. This position of the tank filling device 1 corresponds to a position rotated by 180° in the drawing plane of FIG. 2.

In the closed position of the liquid valve 20, a compensation opening 38 is provided in the area of the valve plate 21 and enables by means of the air inlet 31 venting of the air channel 30 in the closed position of the liquid valve 20.

The air inlet 31 of the air channel 30 and the outlet opening 15 of the pouring spout 12 are positioned in a common plane 39. The sealing ring 22 closes off both the liquid valve 20 and the air inlet 31 with the exception of the expediently provided compensation opening 38. The liquid valve 20 and the air valve 33 are mechanically coupled with each other so that, by means of the opening stroke z, the liquid valve 20 opens first and then the air valve 33 is opened after the control ring 34 has traveled across the control edge 42. The opening action of the air valve 33 which is taking place with delay in comparison to opening of the liquid valve 20 ensures that an initial liquid quantity has been dispensed via the liquid channel 26 and the outlet opening 15 and a—minimal—vacuum has been generated in the liquid container 40. This vacuum ensures that upon opening of the air valve 33 hardly any fuel can enter the air channel 30 from the liquid-filled liquid chamber 27 but instead compensation air can flow from the air inlet 31 in direction of arrow 43 to the air outlet 32 and into the liquid chamber 27.

The actuating section 5 has a divided interior; the separation of the divided interior of the actuating section 5 into a pouring socket 44 and an air channel 30 ensures a fluidically beneficial outflow of the fuel through the liquid channel 26 while at the same time inflow of compensation air in the direction of arrow 43 occurs. The pouring socket 44 and the air channel 30 extend straight along the common longitudinal axis 45.

For filling, for example, a fuel tank 50 (FIG. 3), a liquid container 40 is utilized which is filled with fuel 51 and the mounting end 2 of the tank filling device 1 is screwed liquid-tightly to its pouring spout. The pouring spout 12 of the tank filling device 1 is introduced into the fill socket 46 of the fuel tank 50, wherein the annular flange 13 of the pouring spout 12 is seated on the circumferential rim 47 of the fill socket 46. The pouring spout 12 has an outer diameter A which is smaller than the inner diameter of the fill socket 46. Upon attachment of the tank filling device 1 to the fuel tank 50, the pouring spout 12 projects into the fill socket 46 and the annular flange 13 of the pouring spout 12 rests on the circumferential rim 47 of the fill socket 46.

The base body 4 of the tank filling device 1 is connected fixedly to the liquid container 40. The actuating section 5 is slidable lengthwise relative to the base body 4 fixed to the liquid container 40 in the direction of the longitudinal axis 45 as indicated by double arrow 14.

The slidability of the pouring spout 12 relative to the base body 4 fixed to the liquid container 40 is limited by the end face 48 of the end 6 of the base body 4. Between the annular flange 13 and the end face 48 a travel stroke is delimited which represents the opening stroke z of the tank filling device 1.

When the liquid container 40 with the fuel 51 to be filled in is pushed in the direction of arrow 49 toward the fuel tank 50, the annular flange 13 of the pouring spout 12 first contacts the circumferential rim 47 of the fill socket 46. A further movement of the liquid container 40 in the direction of arrow 49 causes a relative sliding action of the actuating socket 5 relative to the base body 4 of the tank filling device 1 fixed to the liquid container 40. The liquid container 40 can be pushed in the direction of arrow 49 so far onto the fuel tank 50 until the annular flange 13 contacts the end face 48 of the open end 6 of the base body 4.

Figure 4:
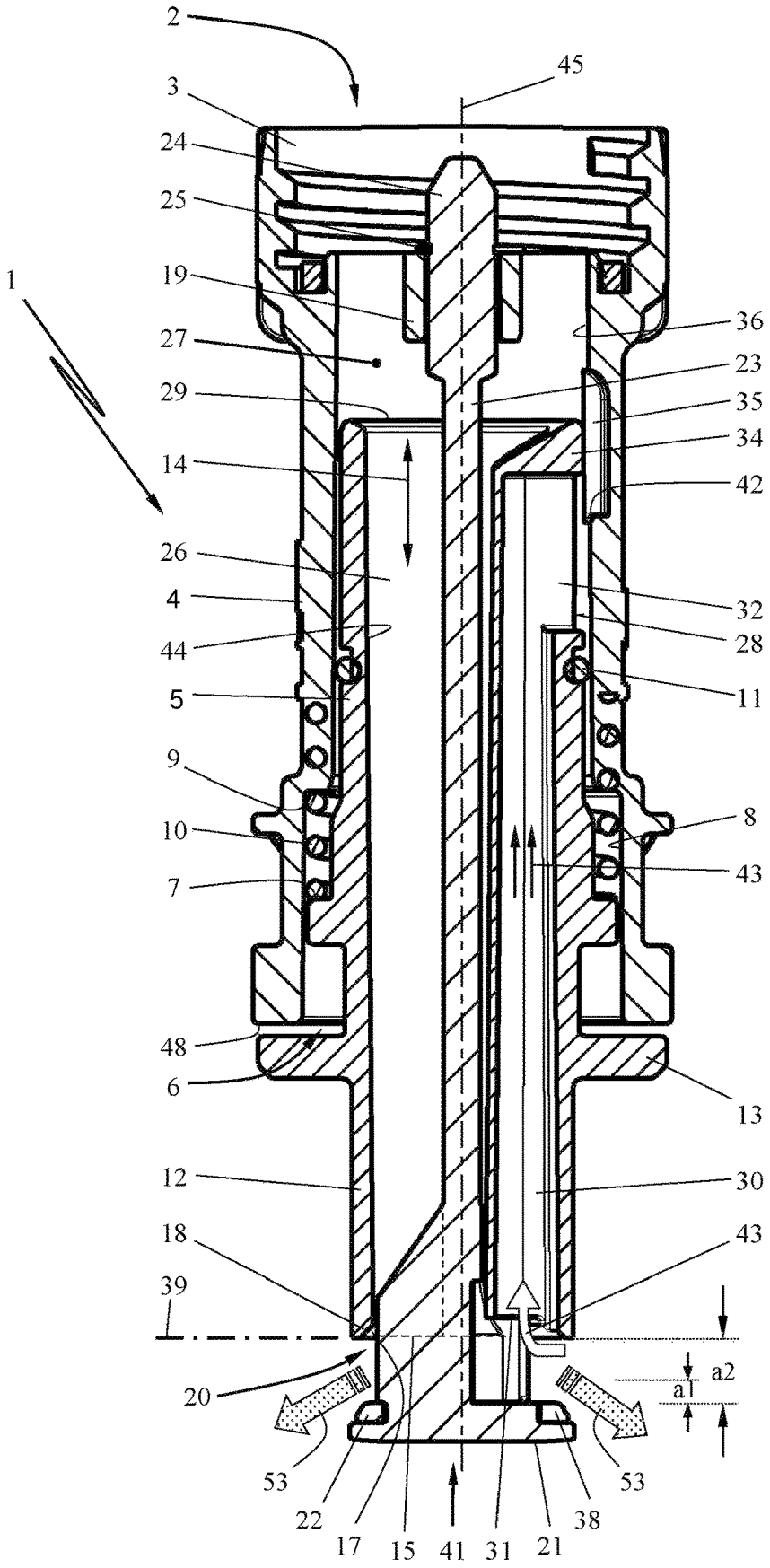
FIG. 4 is a section view of the tank filling device according to FIG. 3 in the open position.

In this position, illustrated in FIG. 4, the liquid valve 20 is completely open and fuel flow in the direction of arrows 52 and 53 occurs. The fuel tank 50 is filled and a vacuum that is generated in the liquid container 40 is compensated by inflowing compensation air which is flowing in through the air channel 30 in the direction of arrow 43.

As illustrated in FIG. 4, in open position of the liquid valve 20, the annular flange 13 is positioned at a minimal spacing relative to the end face 48 of the open end 6 of the base body 4. The liquid valve 20 is open and fuel flows out from the outlet opening 15 in the direction of arrow 53. At the same time, through the air inlet 31 compensation air flows via the air channel 30 and the open air valve 33 into the liquid chamber 27 of the base body 4.

In the illustrated open position of the air valve 33 according to FIG. 4, the control ring 34 is axially approximately centrally positioned in the control slot 35 so that a disruption-free flow around and about the control ring 34 by the incoming compensation air is possible.

The liquid valve 20 and the air valve 33 are mechanically coupled with each other such that the air valve 33 opens with delay relative to the liquid valve 20. In order to ensure this, the control ring 34 overlaps with a length a1 the inner wall surface 36 and this length/overlap a1 corresponds to a partial stroke of the liquid valve 20. Only when the valve plate 21 has traveled a partial stroke length that matches the length/overlap a1, the air valve 33 will open. When the actuating section 5 has traveled the total stroke z, the valve plate 21 is positioned at a spacing a2 in front of the outlet opening 15. The overlap a1 is smaller, in particular several times smaller, than the spacing a2 of the valve plate 21 relative to the outlet opening 15 (see FIG. 4).

In the embodiment according to FIGS. 5 to 13, a preferred configuration of the outlet region is illustrated which can also be advantageous in itself independent of the embodiment of the air valve.

Figure 7:
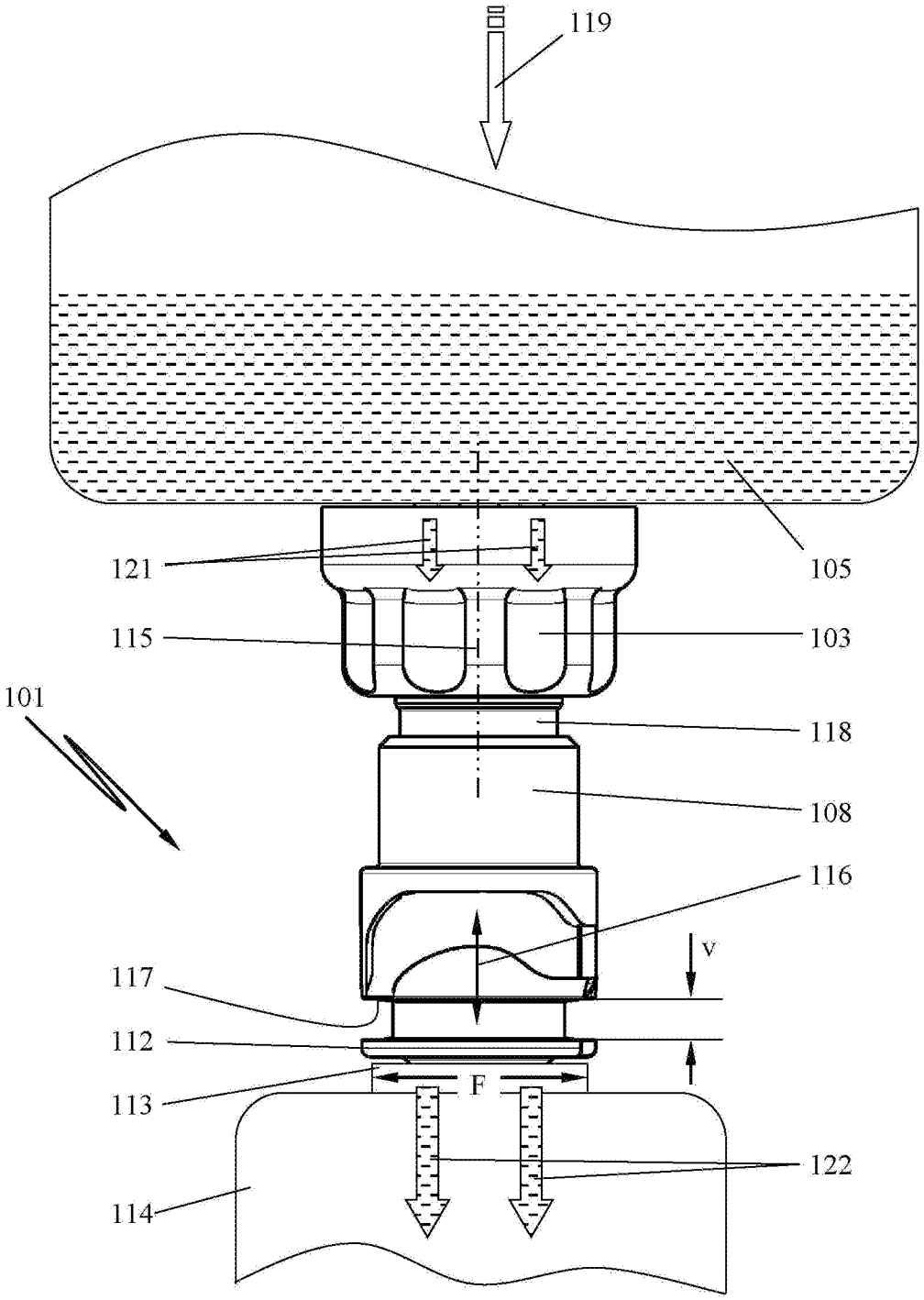
FIG. 7 shows in schematic illustration a tank filling device screwed onto a liquid container in a working position for filling a fuel container.

The tank filling device 101 illustrated in the embodiment comprises a mounting end 102 with a screw cap 103 by means of which a pouring socket 104 is to be attached to a liquid container 105 (FIG. 7). The liquid container 105 is, for example, a fuel container which is carried along by a user for refilling—on site—power tools operated by internal combustion engines.

Figure 5:
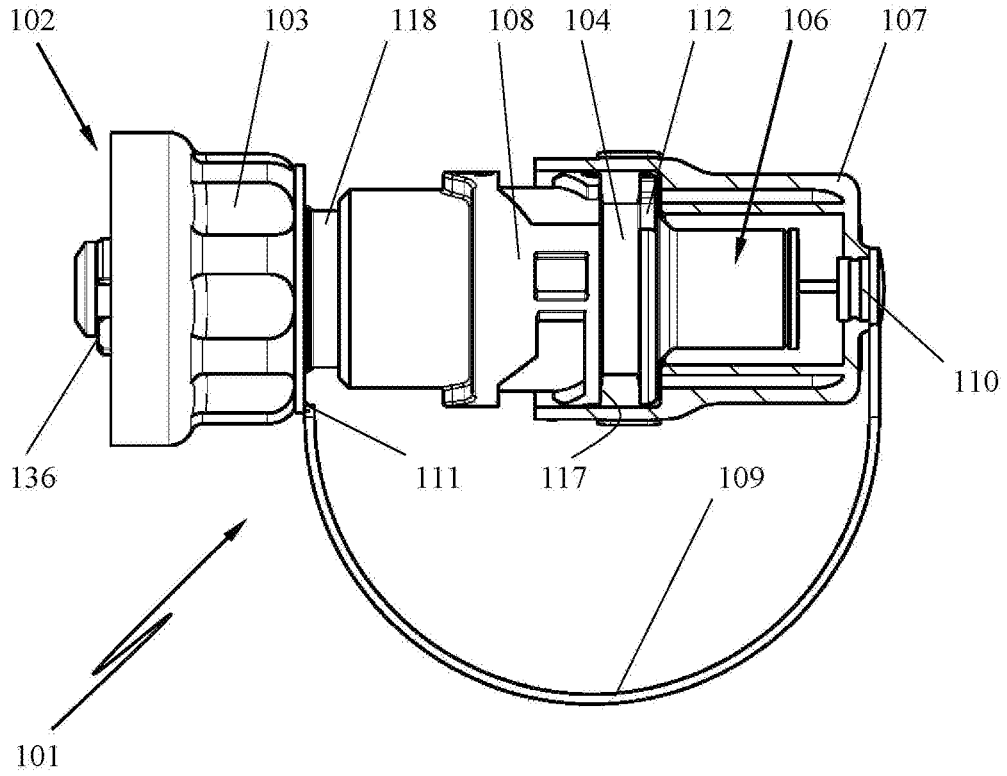
FIG. 5 shows in partial section view a tank filling device with a protective cap that is engaging across the pouring spout.
Figure 6:
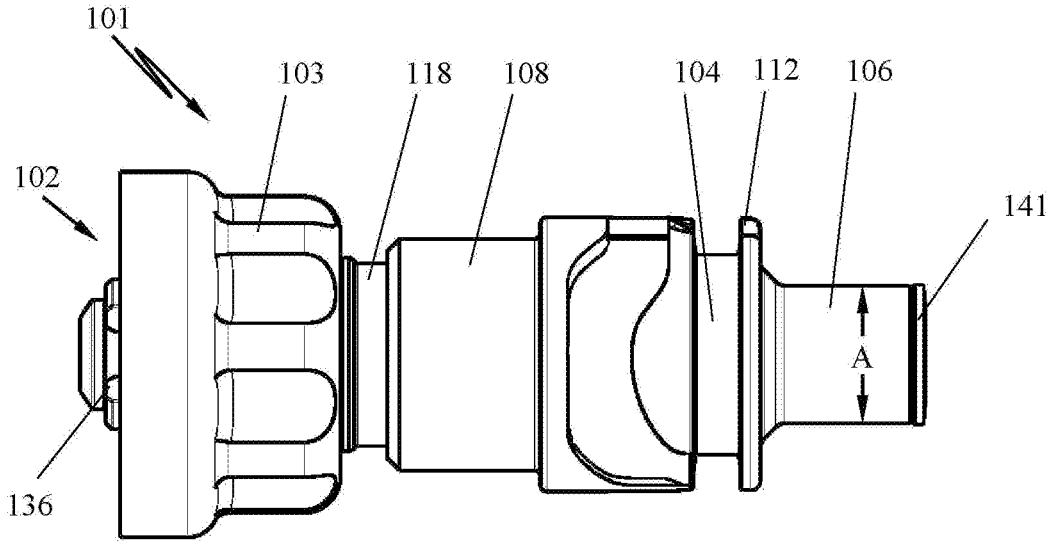
FIG. 6 is a side view of the tank filling device according to FIG. 5 with removed protective cap.

The pouring spout 106 in the illustration according to FIG. 5 is engaged across by a protective cap 107 that can be secured by locking tongues, not illustrated in detail, on a housing section 108 of the tank filling device 101. The protective cap 107 is secured captively by a connecting member 109 with the screw cap 103. The connecting member 109 can be a plastic tab, a cable, or a similar element. One end 110 of the connecting member 109 is clipped captively into an opening of the protective cap 107 in the embodiment; the other end 111 of the connecting member 109 is secured on the screw cap 103.

The pouring spout 106 of the pouring socket 104 has a circumferentially extending flange 112 that, as shown in FIG. 7, with respect to its outer diameter is greater than the outer diameter F of a fill socket 113 of a container to be filled, for example, a fuel tank 114. The pouring spout 106 has an outer diameter A (FIG. 6) that is smaller than the inner diameter of the fill socket 113. Upon placing the tank filling device 101 on the fuel tank 114, the pouring spout 106 projects into the fill socket 113 wherein the flange 112 of the pouring spout 106 comes to rest on the rim of the fill socket 113.

The housing section 108 and an inner support 118 of the tank filling device 101 are connected by the screw cap 103 fixedly to the liquid container 105. The pouring socket 104 is slidably supported relative to the support 118 secured on the housing section 108 and to the housing section 108 in the direction of the longitudinal axis 115 of the tank filling device 101, as indicated by double arrow 116 (FIG. 7). The slidability of the pouring socket 104 relative to the stationary housing section 108 of the tank filling device 101 is limited by the flange 112 which is positioned at a spacing v opposite the facing end face 117 of the housing section 108 fixed relative to the container 105.

When the liquid container 105 is pushed in direction of arrow 119 (FIG. 7) in the direction toward the fuel tank 114, the flange 112 will come into contact with the fill socket 113 of the fuel tank 114. A further movement of the liquid container 105 in the direction of arrow 119 causes a relative movement of the pouring socket 104 relative to the housing parts of the tank filling device 1 fixed to the container 105 so that a liquid valve 145, to be described in the following, is opened which enables fuel flow from the liquid container 105 in the direction of arrows 121 and 122 through the tank filling device 101 into the fuel tank 114.

Figure 8:
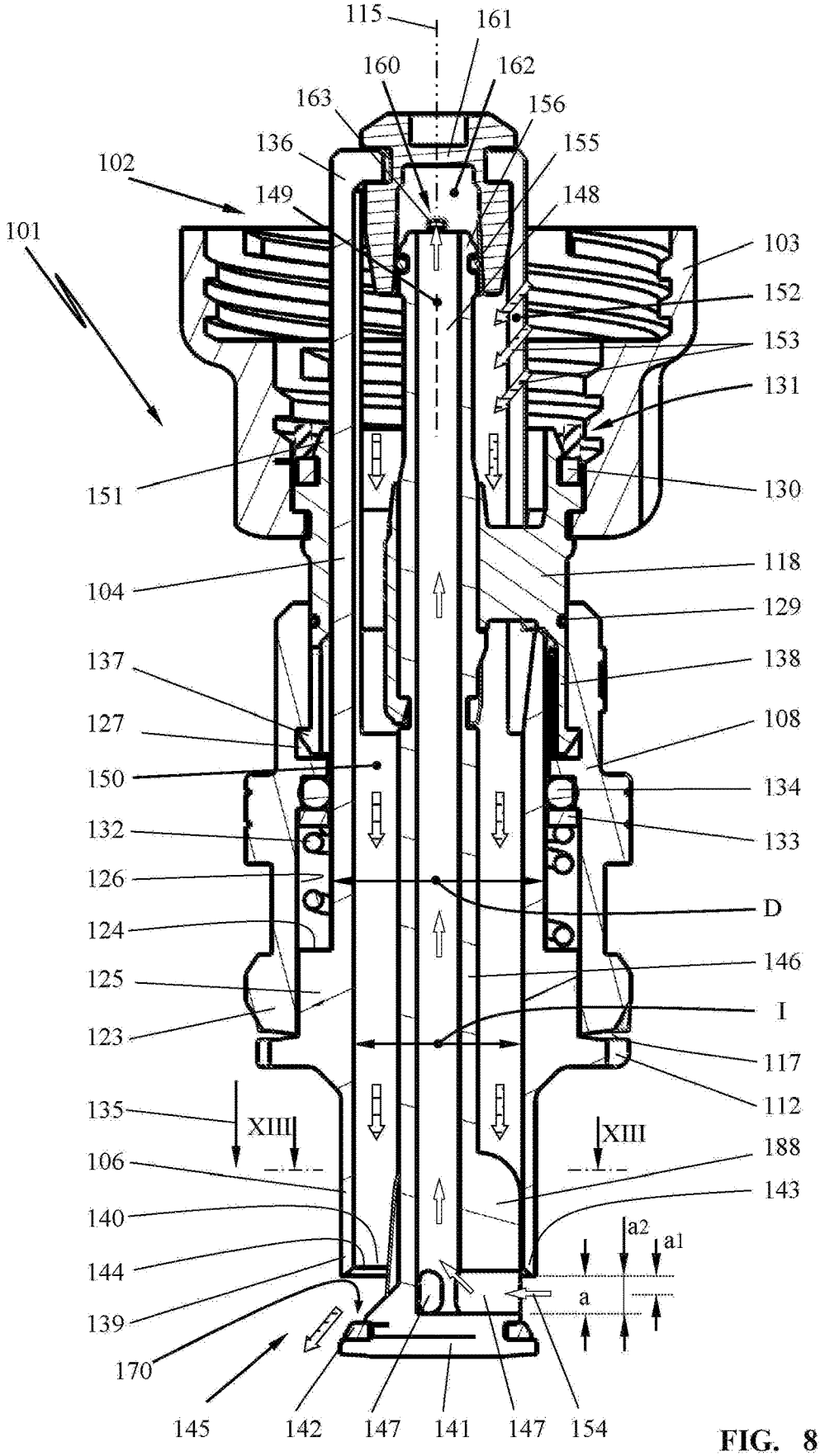
FIG. 8 shows a longitudinal section view of the tank filling device with open liquid valve and air valve.

The configuration of the tank filling device 101 is disclosed in detail in the section view according to FIG. 8. The housing section 108 forms, together with the support 118 and the screw cap 103, the outer housing of the tank filling device 101 wherein the parts 108, 118, 103 are connected to each other axially with form fit. The screw cap 103 is rotatably supported on the support 118 wherein a seal 130 which is arranged in the bottom area 131 of the screw cap 103 provides a sealing action between the screw cap 103 and the support 118. When the screw cap 103 is screwed onto a threaded socket, not illustrated in detail, of the liquid container 105, the rim 151 of the threaded socket will contact the seal 130 so that, when tightly screwing on the screw cap 103, the seal 130 ensures a sealing action relative to the support 118 and the screw cap 103.

The support 118 is clipped onto the cylindrical housing section 108 with its end 138 positioned opposite the screw cap 103. The support 118 with its end 138 engages a sleeve-shaped receptacle 128 of the housing section 108. The locking hooks 137 engage a locking groove 127 in the bottom area of the receptacle 128 and connect the housing section 108 captively to the support 118. A seal 129 is arranged between the end 138 and the receptacle 128 for sealing.

The housing section 108, the support 118, and the screw cap 103 are penetrated by a pouring socket 104 which is embodied so as to extend straight in the direction of the longitudinal axis 115 of the tank filling device 101. The pouring socket 104 has an inner diameter I and an outer diameter D. With its outer diameter D the pouring socket 104 is guided axially slidably in the support 118.

In the region of the free end of the housing section 108, the cylindrical pouring socket 104 has an outer shoulder 124 which is formed on an outer annular flange 125. The annular flange 125 engages axially slidably a spring chamber 126 which is configured as a cylindrical receptacle in the housing section 108.

In the cylindrical spring chamber 126, a spring is arranged which is a coil spring 132 in the embodiment. The spring 132 is supported with one end on the outer shoulder 124 of the annular flange 125 and with the other end the spring 132 is contacting an annular disk 133 which is delimiting a sealing chamber with a seal 134. The seal 134 is preferably an O-ring which is contacting the outer wall surface (outer diameter D) of the pouring socket 104 in a seal tight manner. The pouring socket 104 is thus guided fuel-tightly within the tank filling device 101 so that no liquid can escape to the exterior.

The spring arranged in the spring chamber 126, in the embodiment the coil spring 132, forces by means of outer shoulder 124 the pouring socket 104 in the direction of arrow 135 in downward direction toward a valve member which is designed as a valve plate 141 in the embodiment. Other configurations of the valve member can be advantageous. In the embodiment, the valve plate 141 and/or the valve seal 142 in the illustrated open state is positioned at a spacing a in front of the outlet opening 140 of the pouring spout 106 of the pouring socket 104. The valve plate 141 is secured fixedly on the housing of the tank filling device 101.

Figure 9:
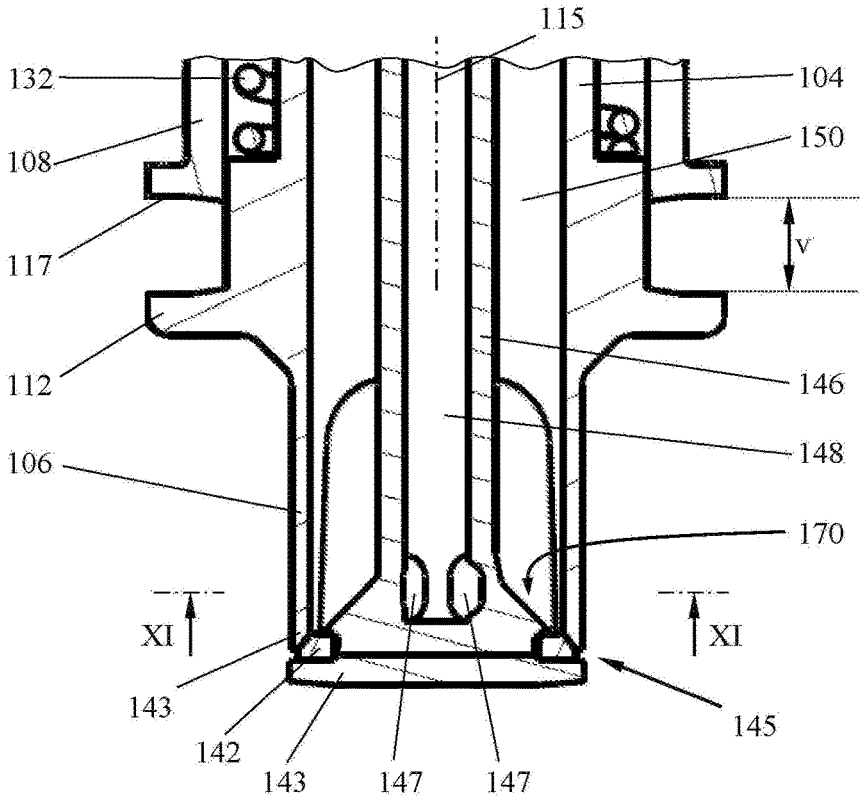
FIG. 9 shows in enlarged illustration the closed liquid valve at the end of the pouring socket in section view.

When the flange 112 provided on the pouring spout 106 is not loaded by external forces, the spring 132 in the spring chamber 126 pushes the pouring socket 104 with its outlet opening 140 against the valve plate 141 so that the pouring socket 104 is closed liquid-tightly, as shown in FIG. 9. For this purpose, on the inner side 170 of the valve member embodied as a valve plate 141 a valve seal 142 is provided which is interacting with an opening rim 144 of the outlet opening 140 that is forming a valve seat 143. The valve member, in the embodiment the valve plate 141, forms together with the valve seat 143 on the outlet opening 140 the liquid valve 145. Independent of the geometric shape of the valve member, a valve seal secured on the valve member is positioned at a spacing a in front of the outlet opening in the open state of the liquid valve 145.

The valve member is secured on a valve stem 146 and is preferably formed as one piece together with the valve stem 146. The valve stem 146 is formed by a tube which is open at the mounting end 102 of the tank filling device 101. The tube opens in the connecting region of the valve member, in the embodiment of the valve plate 141, into a plurality of air sockets 147.

The valve stem 146 comprises thus a central air channel 148 which is extending, preferably centrally, in the center of the tube of the pouring socket 104. In this context, the pouring socket 104 surrounds coaxially the air channel 148 in such a way that the longitudinal center axis 149 of the air channel 148 coincides with the longitudinal center axis of the pouring socket 104 and the longitudinal axis 115 of the tank filling device 101. In this context, the pouring socket 104 also extends, like the air channel 148 or the valve stem 146 accommodating the air channel 148, straight along a common longitudinal center axis which forms the longitudinal axis 115 of the tank filling device 101. The air channel 148 extends in this context from an inner end 136 positioned at the mounting end 102 up to an outer end 139 of the pouring socket 104 that forms the outlet opening 140.

Between the valve stem 146 or the air channel 148 provided in the valve stem 146 and the compensation tube, an annular space 150 is formed through which the liquid is flowing from the mounting end 102 to the outlet opening 140. In the region of the mounting end 102, the pouring socket 104 is provided with longitudinal slots 152 by means of which the liquid or the fuel can enter the annular space 150 in the direction of arrows 153 and flow to the outlet opening 140.

For pressure compensation of the liquid container 105, it is provided that through the open liquid valve 145 incoming ambient air, flowing into the air sockets 147 in the direction of arrow 154, flows via the air channel 148 into the liquid container 105. In this context, the air passes an air valve 160 which is arranged between the inner end 136 of the pouring socket 104 and the inner end 156 of the air channel 148. In the illustrated embodiment the open inner end 136 of the pouring socket 104 is connected to a valve housing 161 which engages across the inner end 156 of the valve stem 146. A seal 155 is arranged between the inner end 156 of the valve stem 146 and the valve housing 161.

In the wall of the cylindrical valve chamber 162, a venting opening 163 is formed; a plurality of venting openings 163 can be provided about the circumference of the wall of the valve chamber 162 at the same level. The venting openings can also be designed as slots extending in axial direction.

In FIG. 8, the liquid valve 145 is illustrated in completely open position. The flange 112 is contacting the end face 117 of the housing section 108. The valve plate 141 is positioned at a spacing a in front of the valve seat 143.

Figure 10:
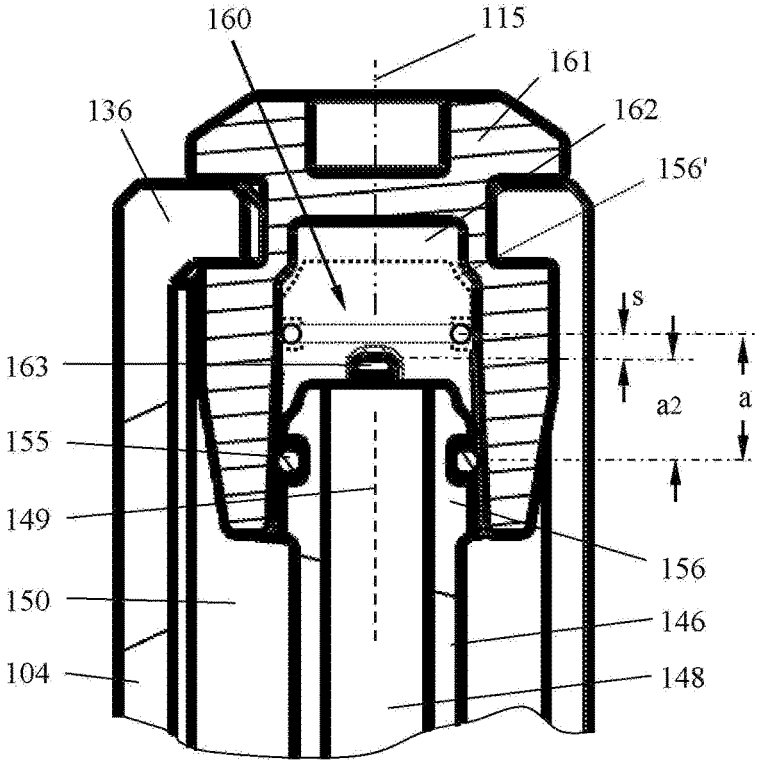
FIG. 10 shows in section view in enlarged illustration the air valve which is arranged in the air channel.

In this completely open position of the liquid valve 145, the air valve 160 is also open, as shown in the enlarged illustration of FIG. 10.

The position of the seal 155 on the inner end 156 of the valve stem 146 is provided such that, in closed position of the liquid valve 145, the air valve 160 is also closed; this is illustrated in dashed illustration of the inner end 156' in FIG. 10. In this closed position of the air valve 160, the seal 155 is above the venting opening 163. In the direction of the longitudinal axis 115 in the closed position of the liquid valve 145, the seal 155 is positioned at a spacings relative to the top edge of the venting opening 163 so that the air valve 160, despite a mechanical coupling with the liquid valve 145, does not open simultaneously with the liquid valve 145. Instead, the liquid valve 145 must first carry out an opening stroke a1 and the air valve 160 must travel across the distance s before the air valve 160 opens. The provided opening stroke a1 corresponds expediently to the spacing s at which the seal 155 in the closed position of the liquid valve 145 is positioned above the venting opening 163.

When the liquid valve 145 has carried out the predetermined opening stroke a1, the seal 155 is positioned, as a result of the mechanical coupling between liquid valve and air valve, at the level of the venting opening 163 so that the air valve 160 opens as the further opening stroke a2 is carried out. The mechanical coupling between liquid valve 145 and air valve 160 is thus configured such that the air valve 160 opens with time delay after the liquid valve 145 opens. The liquid valve 145 carries out a maximum opening stroke a1+a2 from the closed state (FIG. 9) into the open state (FIG. 8). The air valve 160 opens already when, from the closed state of the liquid valve 145, a predetermined opening stroke a1 has been traveled. This predetermined opening stroke a1 is smaller than the maximum opening stroke a1+a2.

The liquid valve 145, which is to be opened manually by pushing down the tank filling device 101 against the fill socket 113, serves not only for supply of liquid into a fuel container 114 but also at the same time for venting the liquid container 105 for compensation of the vacuum which is produced by the outflowing fuel.

Figure 11:
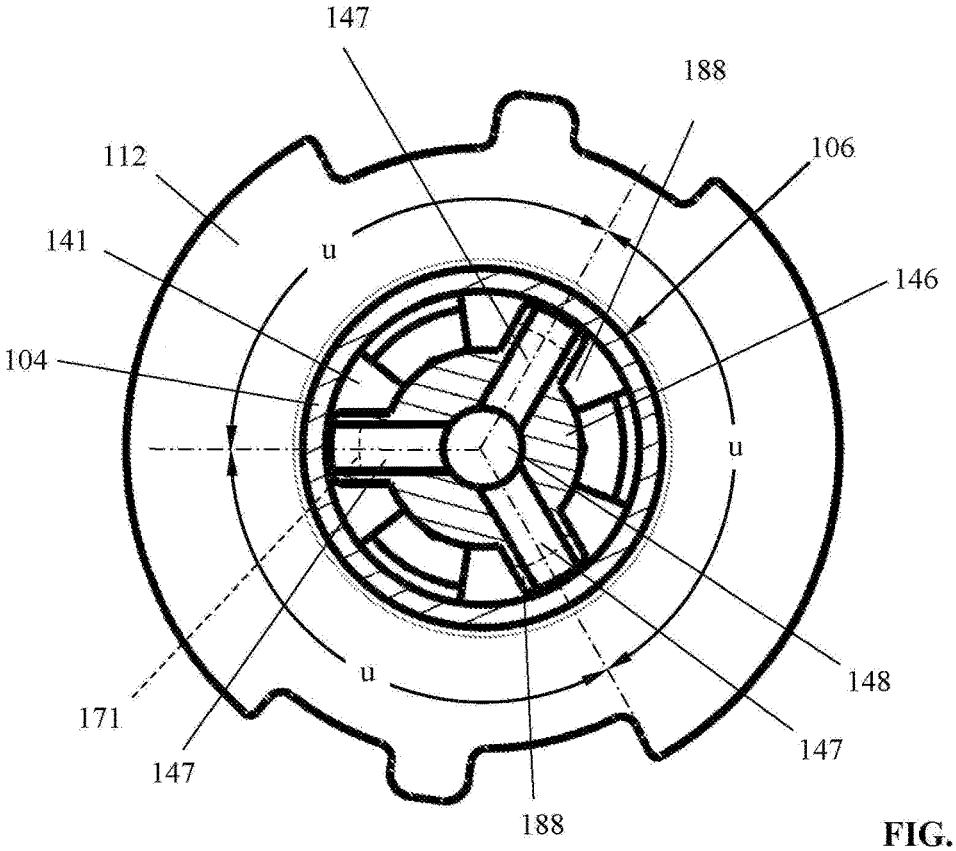
FIG. 11 is a section view along the section line XI-XI of FIG. 9.

As is shown in the view of FIG. 11, the air channel 148 ends in particular centrally above the valve plate 141 wherein the air sockets 147, as shown in FIG. 8, are oriented radially relative to the longitudinal axis 149 of the valve stem 146. As shown in FIG. 11, about the circumference a plurality, in particular three, air sockets 147 are provided which in the embodiment are positioned in circumferential direction at identical spacing u relative to each other. In the embodiment, three air sockets 147 at a spacing u of 120° are provided. The air sockets 147 together join the air channel 148 in the valve stem 146 at the center of the valve plate 141. The longitudinal center axis of an air socket 147 and the longitudinal center axis 149 of the valve stem 146 are positioned preferably at a right angle to each other.

The air sockets 147 are provided in ribs 188 which are provided in the region between the inner wall of the pouring socket 104 or its pouring spout 106 and the valve stem 146 (compare FIG. 8). The ribs 188 are advantageously embodied as one piece together with the valve stem 146 and penetrate the annular space 150. The ribs 188 guide the valve stem 146 in the region of the liquid valve 145 within the pouring spout 106 so that the end of the valve stem 146 in open position (compare FIG. 8) and in closed position (compare FIG. 9) is radially guided. The ribs 188 are longer in longitudinal direction of the valve stem 146 than the opening stroke a1+a2 of the valve 145. Preferably, the ribs 188 extend axially across a length of twice to three times the length of the opening stroke a1+a2.

Figure 12:
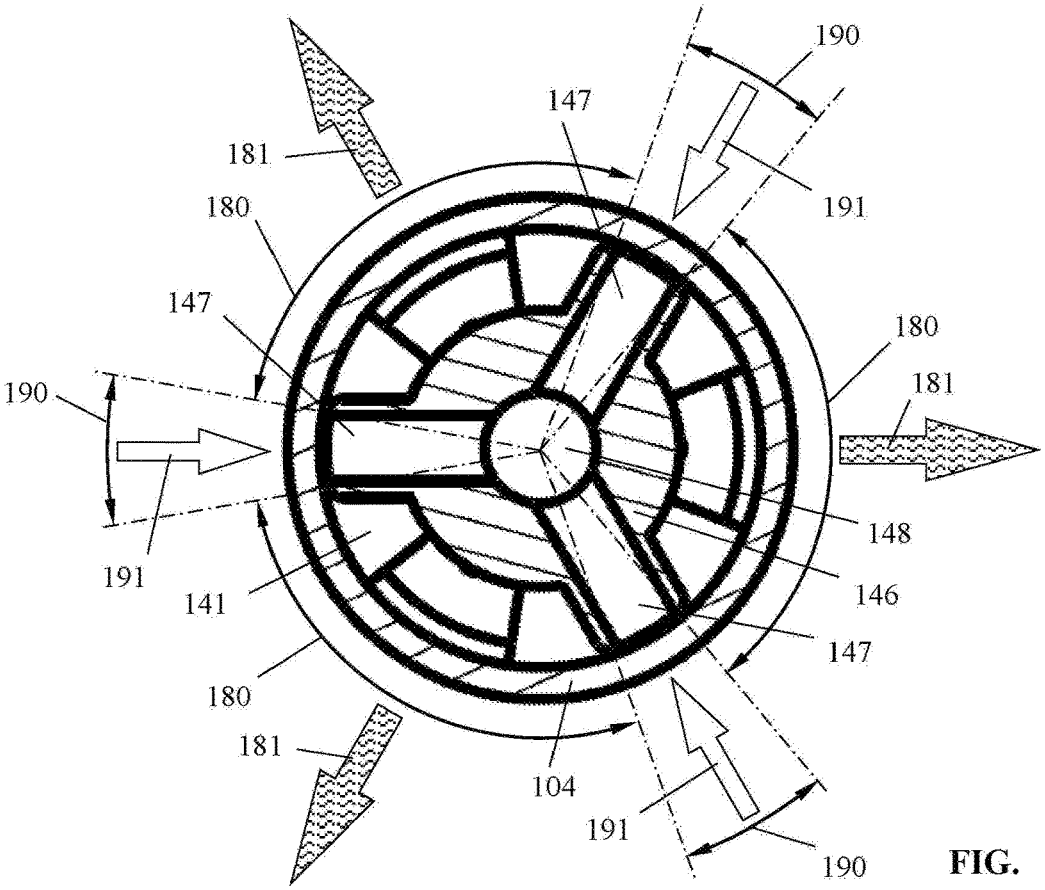
FIG. 12 is a section illustration according to FIG. 10 with schematic illustration of outflow regions and inflow regions.

As shown in FIG. 12, outflow regions 180 are provided for the liquid, in the embodiment for the fuel, between the air sockets 147. Correspondingly, inflow regions 190 are formed for the inflowing ambient air. In FIG. 12, the outflowing fuel is indicated with arrows 181. The incoming ambient air is indicated by arrows 191. In this context, the ribs 188 can be provided as dividers of the incoming fuel that is flowing into the liquid valve 145 so that, above the air sockets 147, the fuel is directed to the right and to the left into the outflow regions 180.

As shown in FIG. 12 in detail, about the circumference of the valve plate 141 outflow regions 180 for the liquid and inflow regions 190 for the ambient air are alternatingly arranged next to each other, in particular uniformly distributed. In this way, sequentially arranged outflow regions 180 for outflow of the liquid, in the embodiment of the fuel, and inflow regions 190 for inflow of ambient air into the air channel 148 are formed in circumferential direction on the valve plate 141. The angular range of an outflow region 180 measured in circumferential direction is greater, advantageously several times greater, than the angular range of an inflow region 190 measured in circumferential direction. In the embodiment, an outflow region 180 extends across 100° and an inflow region 190 extends across 20°.

The air sockets 147, as shown in FIG. 11, can be designed such that with their end 171 forming an air inlet they are positioned on a diameter that is smaller than the inner diameter I of the pouring socket 104. In plan view of the valve plate 141, the air sockets 147 are located within the annular space 150. The ends 171 are thus positioned in the annular space 150.

According to the preferred embodiment, the air sockets 147 are extended to the rim 157 of the valve plate. In plan view of the valve plate 141 according to FIG. 11, the air sockets 147 end at the inner circumference of the pouring socket 104.

Figure 13:
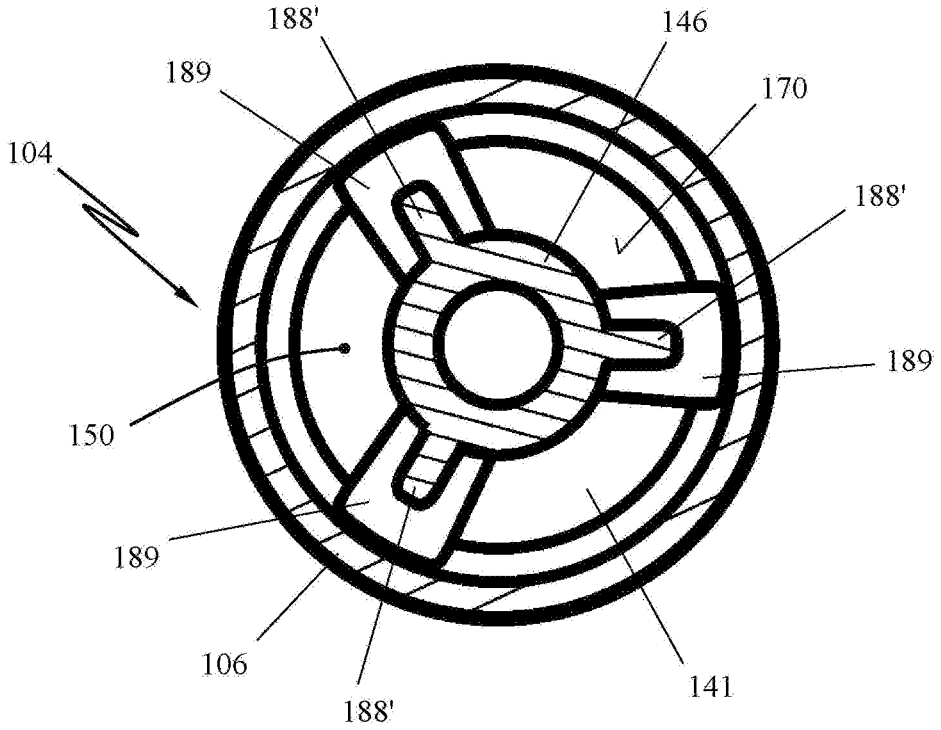
FIG. 13 is a section view along the section line XIII-XIII of FIG. 8.

In the illustration according to FIG. 13, a section along the section line XIII-XIII in FIG. 8 is illustrated. The valve stem 146 has on its outer wall surface guide ribs 188' which are guided in fill members 189 in the longitudinal direction of the valve stem 146. In this way, the end of the valve stem 146 carrying the valve plate 141 is radially guided in the region of the pouring spout 106 of the pouring socket 104. In the open position as well as in the closed position of the liquid valve 145, the valve stem 146 is always centered. Canting during an opening movement or closing movement of the liquid valve 145 is thus avoided.

The fill members 189, as can be seen in the view of FIG. 13, can completely penetrate the annular space 150 between the valve stem 146 and the inner wall of the pouring spout 106 and can contact the outer wall surface of the valve stem 146. The fill members 189 are thus expediently secured in the pouring spout 106 or in the pouring socket 104 so that the valve stem 146 moves relative to the fill members 189. The fill members 189 are positioned above the air socket 147 (FIG. 11) so that the fill members 189 form a type of roof or cover for the air sockets 147. The fuel flow which is flowing through the annular space 150 to the liquid valve 145 is divided by the fill members 189 above the air sockets 147 so that in the area of the open mouths of the air sockets 147 (FIG. 8) no fuel is flowing out. The fuel is deflected in circumferential direction by the fill members 189 to the right or left and exits via the outflow region 180. The inflow regions 190 for the compensating air are thus substantially free of fuel so that hardly any or substantially no liquid or fuel can flow in through the air sockets 147. In this way, it is ensured that sufficient air can flow through the air sockets 147 and the air channel 148 into the liquid container 105 for pressure compensation.

The specification incorporates by reference the entire disclosure of German priority document 10 2016 009 489.3 having a filing date of Aug. 5, 2016.

While specific embodiments of the invention have been shown and described in detail to illustrate the inventive principles, it will be understood that the invention may be embodied otherwise without departing from such principles.

What is claimed is:

1. A tank filling device for a liquid container, the tank filling device comprising:

a base body comprising a mounting end configured to secure the base body on a liquid container;

an actuating section disposed in an interior of the base body so as to be slidable lengthwise relative to the base body, wherein the actuating section comprises a first end and a second end opposite the first end in a length direction of the actuating section, wherein the first end is facing the base body and the second end is facing away from the base body;

an outlet opening for outflowing liquid;

a liquid valve operatively connected to the outlet opening for controlling the outlet opening, wherein the liquid valve is arranged at the second end of the actuating section and coupled to the actuating section such that the liquid valve is manually opened or closed when the actuating section is moved relative to the base body;

an air channel comprising an air inlet and an air outlet and further comprising an air valve disposed at the air outlet, the air channel configured to supply air into the liquid container for pressure compensation in the liquid container, wherein the air channel extends from a region where the liquid valve is arranged in a direction toward the mounting end, wherein the air valve is arranged at the first end of the actuating section and is spaced apart from the liquid valve in the length direction;

wherein the air outlet of the air channel is provided between the actuating section and the base body;

wherein the air valve is embodied as a slot control valve and is formed by the actuating section and the base body;

wherein the air valve and the liquid valve are mechanically coupled with each other such that sliding the actuating section relative to the base body displaces the air outlet, and the air outlet is positioned such that the air valve opens with delay relative to the liquid valve.

2. The tank filling device according to claim 1, wherein the air outlet of the air channel is provided in the actuating section and is facing an inner wall surface of the base body.

3. The tank filling device according to claim 1, wherein the air valve comprises a compensation cross section that is open in a closed position of the air valve.

4. The tank filling device according to claim 3, wherein the air valve has an opening cross section in an open position of the air valve and wherein the compensation cross section amounts to 1% to 5% of the opening cross section of the air valve.

5. The tank filling device according to claim 1, wherein the air inlet of the air channel is positioned in a plane of the outlet opening.

6. The tank filling device according to claim 1, wherein the liquid valve comprises a valve seat and a valve member, wherein the valve member is configured to close both the liquid valve and the air inlet.

7. The tank filling device according to claim 6, wherein the valve member is a valve plate.

8. The tank filling device according to claim 6, wherein the liquid valve comprises a valve stem centrally penetrating the actuating section and wherein the valve member is secured on the valve stem.

9. The tank filling device according to claim 1, wherein the air inlet comprises a compensation opening and the compensation opening remains open relative to the interior of the base body when the liquid valve is in a closed position.

10. The tank filling device according to claim 1, wherein the actuating section comprises a divided interior, wherein the air channel is provided in the divided interior, wherein the divided interior further comprises a liquid channel, wherein the liquid channel and the air channel extend straight in the divided interior along a longitudinal axis of the actuating section.

11. The tank filling device according to claim 1, wherein the air outlet opens at a circumferential region of the actuating section.

12. A tank filling device for a liquid container, the tank filling device comprising:

a base body comprising a mounting end configured to secure the base body on a liquid container;

an actuating section disposed in an interior of the base body so as to be slidable lengthwise relative to the base body, wherein the actuating section comprises a first end and a second end opposite the first end in a length direction of the actuating section, wherein the first end is facing the base body and the second end is facing away from the base body;

an outlet opening for outflowing liquid;

a liquid valve operatively connected to the outlet opening for controlling the outlet opening, wherein the liquid valve is arranged at the second end of the actuating section and coupled to the actuating section such that the liquid valve is manually opened or closed when the actuating section is moved relative to the base body;

an air channel comprising an air inlet and an air outlet and further comprising an air valve disposed at the air outlet, the air channel configured to supply air into the liquid container for pressure compensation in the liquid container, wherein the air channel extends from a region where the liquid valve is arranged in a direction toward the mounting end, wherein the air valve is arranged at the first end of the actuating section and is spaced apart from the liquid valve in the length direction;

wherein the air outlet of the air channel is provided between the actuating section and the base body;

wherein the air valve is formed by the actuating section and the base body and is embodied as a slot control valve such that the air outlet opens in a circumferential region at the outer circumference of the actuating section and such that the air outlet has associated therewith a control slot disposed in an inner wall surface of the base body, wherein the control slot is a cutout extending axially across a height of the base body;

wherein the air valve and the liquid valve are mechanically coupled with each other such that sliding the actuating section relative to the base body displaces the air outlet, and the air outlet is positioned such that the air valve opens with delay relative to the liquid valve.

* * * * *